US010170051B2

(12) United States Patent
Jin

(10) Patent No.: US 10,170,051 B2
(45) Date of Patent: Jan. 1, 2019

(54) DRIVING METHOD FOR OLED DISPLAY PANEL

(71) Applicant: Shenzhen China Star Optoelectronics Semiconductor Display Technology Co., Ltd., Shenzhen (CN)

(72) Inventor: Yufeng Jin, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/570,371

(22) PCT Filed: Jul. 13, 2017

(86) PCT No.: PCT/CN2017/092685
§ 371 (c)(1),
(2) Date: Oct. 30, 2017

(65) Prior Publication Data

US 2018/0350303 A1 Dec. 6, 2018

(30) Foreign Application Priority Data

Jun. 2, 2017 (CN) ..... 2017 1 0408750

(51) Int. Cl.
*G09G 3/3258* (2016.01)
*G09G 3/20* (2006.01)

(52) U.S. Cl.
CPC ..... *G09G 3/3258* (2013.01); *G09G 3/2003* (2013.01); *G09G 2300/0452* (2013.01);
(Continued)

(58) Field of Classification Search
None
See application file for complete search history.

(56) References Cited

U.S. PATENT DOCUMENTS

2016/0155377 A1* 6/2016 Kishi ..... G09G 3/3233 345/214
2018/0012546 A1* 1/2018 Li ..... G09G 3/3233

FOREIGN PATENT DOCUMENTS

CN 103165078 A 6/2013
CN 103578411 A 2/2014
(Continued)

*Primary Examiner* — Kenneth B Lee, Jr.
(74) *Attorney, Agent, or Firm* — Leong C. Lei

(57) ABSTRACT

The invention provides driving methods for OLED display panel. One method uses an improved driving circuit: disposing a sensing line (S(a)) corresponding to two columns of pixels (P), the a-th sensing line (S(a)) synchronously detecting threshold voltages of the light-emitting sub-pixels of odd-numbered rows in (2a−1)-th column pixels (P) and of even-numbered rows in 2a-th column pixels (P); or, the a-th sensing line (S(a)) synchronously detecting threshold voltages of the light-emitting sub-pixels of even-numbered rows in (2a−1)-th column pixels (P) and of odd-numbered rows in 2a-th column pixels (P); to perform detection on half of the sub-pixels in OLED display panel, to reduce the number of sensing lines by half to save cost. Another method improves the driving signal timing sequence to reduce the number of detection times of the sensing lines by half with obtaining the threshold voltages of all the sub-pixels of the OLED display panel.

9 Claims, 11 Drawing Sheets

(52) U.S. Cl.
CPC ... *G09G 2310/08* (2013.01); *G09G 2320/029* (2013.01); *G09G 2330/02* (2013.01)

(56) References Cited

FOREIGN PATENT DOCUMENTS

| | | | |
|---|---|---|---|
| CN | 104715717 | A | 6/2015 |
| CN | 104809986 | A | 7/2015 |
| CN | 105047137 | A | 11/2015 |
| CN | 105261330 | A | 1/2016 |
| CN | 105741776 | A | 7/2016 |
| CN | 106683615 | A | 5/2017 |
| KR | 20110032937 | A | 3/2011 |

* cited by examiner

DRIVING METHOD FOR OLED DISPLAY PANEL

BACKGROUND OF THE INVENTION

1. Field of the Invention

The present invention relates to the field of OLED display device techniques, and in particular to a driving method for OLED display panel.

2. The Related Arts

The organic light emitting diode (OLED) display panel provides the advantages of active light-emitting, low driving voltage, high emission efficiency, quick response time, high resolution and contrast, near 180° viewing angle, wide operation temperature range, and capability to realize flexible display and large-area full-color display, and is regarded as the most promising display technology. As the OLED display panel becomes ubiquitous, the demands on the display quality get increasingly higher. The electrical compensation to the OLED display panel becomes important, and therefore, it is necessary to perform sensing on the threshold voltage of the OLED display panel.

Refer to FIG. 1. The known driving circuit of OLED display panel comprises a plurality of pixels P' arranged in an array, a plurality of scan lines G(n)' (n being an positive integer) arranged from top down and horizontally extending, a plurality of data lines D(m)' (m being a positive integer) arranged from left to right and vertically extending, and a plurality of sensing lines S(a)' (a being a positive integer) arranged from left to right and vertically extending; wherein each pixel P' comprising a red sub-pixel R', a green sub-pixel G' and a blue sub-pixel B', arranged from left to right; a scan line G(n)' being disposed correspondingly and electrically connected to each row of sub-pixels, a data line D(m)' being disposed correspondingly and electrically connected to each column of sub-pixels, a sensing line S(a)' being disposed and electrically connected to corresponding three columns of sub-pixels, i.e., each column of pixels P' sharing a sensing line S(a)'.

Refer to FIG. 2. The driving timing sequence for the driving circuit shown in FIG. 1 is: in top-down order, each scan line G(n)' successively transmits three scan signals $G(n_1)'$, $G(n_2)'$, $G(n_3)'$; and within the operation period of scan signal $G(n_1)'$, the data line D(m)' electrically connected to the red sub-pixel R' transmits data signal Data' to drive the red sub-pixel R' to emit light; within the operation period of scan signal $G(n_2)'$, the data line D(m)' electrically connected to the green sub-pixel G' transmits data signal Data' to drive the green sub-pixel G' to emit light; within the operation period of scan signal $G(n_3)'$, the data line D(m)' electrically connected to the blue sub-pixel B' transmits data signal Data' to drive the blue sub-pixel B' to emit light; each sensing line S(a)' synchronously detects the threshold voltage of the light-emitting sub-pixels.

For example, the first scan line G(1)' successively transmits three scan signals $G(\mathbf{1}_1)'$, $G(\mathbf{1}_2)'$, $G(\mathbf{1}_3)'$; and within the operation period of scan signal $G(\mathbf{1}_1)'$, the first data line D(1)' electrically connected to the red sub-pixel R' transmits data signal Data' to drive the red sub-pixel R' to emit light; within the operation period of scan signal $G(\mathbf{1}_2)'$, the second data line D(2)' electrically connected to the green sub-pixel G' transmits data signal Data' to drive the green sub-pixel G' to emit light; within the operation period of scan signal $G(\mathbf{1}_3)'$, the third data line D(3)' electrically connected to the blue sub-pixel B' transmits data signal Data' to drive the blue sub-pixel B' to emit light; the first sensing line S(1)' synchronously detects the threshold voltage of the sub-pixels of the first to the third columns of the first row, and the number of detections is three times. Similarly, other sensing lines S(a)' synchronously detects the sub-pixels of corresponding columns in the first row three times.

Then, the second scan line G(2)' successively transmits three scan signals $G(\mathbf{2}_1)'$, $G(\mathbf{2}_2)'$, $G(\mathbf{2}_3)'$; and within the operation period of scan signal $G(\mathbf{2}_1)'$, the first data line D(1)' electrically connected to the red sub-pixel R' transmits data signal Data' to drive the red sub-pixel R' to emit light; within the operation period of scan signal $G(\mathbf{2}_2)'$, the second data line D(2)' electrically connected to the green sub-pixel G' transmits data signal Data' to drive the green sub-pixel G' to emit light; within the operation period of scan signal $G(\mathbf{2}_3)'$, the third data line D(3)' electrically connected to the blue sub-pixel B' transmits data signal Data' to drive the blue sub-pixel B' to emit light; the first sensing line S(1)' synchronously detects the threshold voltage of the sub-pixels of the first to the third columns of the second row, and the number of detections is three times. Similarly, other sensing lines S(a)' synchronously detects the sub-pixels of corresponding columns in the second row three times.

And so on.

According to the above driving method, the detection must be performed to all the sub-pixels in FIG. 3 (the sub-pixel under detection is shaded). Assume that the number of pixels P' in an OLED display panel is 1920×1080, then the number of sensing lines S(a)' is 1920, and the number of detection times of each sensing line is 1080×3=3240. In short, the number of the sensing lines S(a)' is large, the cost is high, and the detection time is long and inefficient.

SUMMARY OF THE INVENTION

The object of the present invention is to provide a driving method for OLED display panel, requiring only performing detection on half of the sub-pixels to reduce the number of sensing lines as well as the cost.

Another object of the present invention is to provide a driving method for OLED display panel, requiring only performing detection on half of the sub-pixels to reduce the number of detection times for each sensing lines as well as reduce the detection time and increase efficiency.

To achieve the above object, the present invention provides a driving method for OLED display panel, which comprises the steps of:

Step 1: providing an OLED display panel;

the OLED display panel being disposed with a driving circuit, m, n, a being positive integers, the driving circuit comprising: a plurality of pixels arranged in an array, a plurality of scan lines arranged from top down and horizontally extending, a plurality of data lines arranged from left to right and vertically extending, and a plurality of sensing lines arranged from left to right and vertically extending;

wherein, each pixel comprising: a red sub-pixel, a green sub-pixel, and a blue sub-pixel, arranged from left to right; a scan line being disposed correspondingly and electrically connected to each row of sub-pixels, a data line being disposed correspondingly and electrically connected to each column of sub-pixels, a sensing line being disposed and electrically connected to corresponding two columns of pixels; the a-th sensing line being electrically connected to all the sub-pixels of the odd-numbered rows in the (2a−1)-th column and all the sub-pixels in the even-numbered rows in the 2a-th column; or, the a-th sensing line being electrically connected to all the sub-pixels of the even-numbered rows in the (2a−1)-th column and all the sub-pixels of the odd-numbered rows in the 2a-th column;

Step S2: in a top-down order, each scan line successively transmitting three scan signals; and within the operation period of the first scan signal, the data line electrically connected to the red sub-pixel transmitting a data signal to drive the red sub-pixel to emit light; within the operation period of the second scan signal, the data line electrically connected to the green sub-pixel transmitting a data signal to drive the green sub-pixel to emit light; within the operation period of the third scan signal, the data line electrically connected to the blue sub-pixel transmitting a data signal to drive the blue sub-pixel to emit light;

the a-th sensing line synchronously detecting threshold voltages of the light-emitting sub-pixels of the odd-numbered rows in the (2a−1)-th column and the light-emitting sub-pixels of the even-numbered rows in the 2a-th column; or, the a-th sensing line synchronously detecting threshold voltages of the light-emitting sub-pixels of the even-numbered rows in the (2a−1)-th column and the light-emitting sub-pixels of the odd-numbered rows in the 2a-th column; so as to accomplish performing detection on half of the sub-pixels in the OLED display panel;

Step S3: based on the threshold voltages of the detected sub-pixels, calculating threshold voltages of the sub-pixels of the same color not performed with detection.

According to a preferred embodiment of the present invention, in Step S3, the threshold voltages of the sub-pixels of the same color not performed with detection is obtained by calculating an average of the threshold voltages of the sub-pixels of the same color at four (i.e., upper, lower, left, and right) adjacent positions that have been performed with detection, with the following equations:

$$R''=(R_U+R_L+R_{LF}+R_R)/4;$$

$$G''=(G_U+G_L+G_{LF}+G_R)/4;$$

$$B''=(B_U+B_L+B_{LF}+B_R)/4;$$

Wherein R" is the threshold voltage of a red sub-pixel not performed with detection, $R_U$, $R_L$, $R_{LF}$, and $R_R$ are threshold voltages of the adjacent red sub-pixels that have been performed with detection in the upper, lower, left and right directions respectively; G" is the threshold voltage of a green sub-pixel not performed with detection, $G_U$, $G_L$, $G_{LF}$, and $G_R$ are threshold voltages of the adjacent green sub-pixels that have been performed with detection in the upper, lower, left and right directions respectively; and B" is the threshold voltage of a blue sub-pixel not performed with detection, $B_U$, $B_L$, $B_{LF}$, and $B_R$ are threshold voltages of the adjacent blue sub-pixels that have been performed with detection in the upper, lower, left and right directions respectively.

According to a preferred embodiment of the present invention, the first scan signal, the second scan signal, the third scan signal of each scan line, and the data signal are provided by an external timing controller.

According to a preferred embodiment of the present invention, each sub-pixel comprises a switch thin film transistor (TFT), a driving TFT, and an organic light-emitting diode (OLED); the switch TFT has a gate electrically connected to the scan line corresponding to the row of the sub-pixel, a drain electrically connected to the data line corresponding to the column of the sub-pixel, and a source electrically connected to a gate of the driving TFT; the driving TFT has a drain connected to receive a power source voltage, a source electrically connected to an anode of the OLED; and the OLED has a cathode grounded; and, the sensing line is electrically connected to the source of the driving TFT of the corresponding sub-pixel.

Another embodiment of the present invention also provides a driving method for OLED display panel, which comprises the steps of:

Step 100: providing an OLED display panel;

the OLED display panel being disposed with a driving circuit, m, n, a being positive integers, the driving circuit comprising: a plurality of pixels arranged in an array, a plurality of scan lines arranged from top down and horizontally extending, a plurality of data lines arranged from left to right and vertically extending, and a plurality of sensing lines arranged from left to right and vertically extending;

wherein, each pixel comprising: a red sub-pixel, a green sub-pixel, and a blue sub-pixel, arranged from left to right; a scan line being disposed correspondingly and electrically connected to each row of sub-pixels, a data line being disposed correspondingly and electrically connected to each column of sub-pixels, a sensing line being disposed and electrically connected to corresponding two columns of pixels; the a-th sensing line being electrically connected to all the sub-pixels in the a-th column;

Step S200: in a top-down order, the n-th scan line successively transmitting two scan signals; and within the operation period of the first scan signal, the data line electrically connected to the red sub-pixel transmitting a data signal to drive the red sub-pixel to emit light; within the operation period of the second scan signal, the data line electrically connected to the blue sub-pixel transmitting a data signal to drive the blue sub-pixel to emit light; and then, the (n+1)-th scan line transmitting a scan signal, and within the operation period of the scan signal, the data line electrically connected to the green sub-pixel transmitting a data signal to drive the green sub-pixel to emit light;

the a-th sensing line synchronously detecting threshold voltages of the light-emitting sub-pixels of the a-th column so as to accomplish performing detection on half of the sub-pixels in the OLED display panel;

Step S300: based on the threshold voltages of the detected sub-pixels, calculating threshold of the sub-pixels of the same color not performed with detection.

According to a preferred embodiment of the present invention, in Step S300, the threshold voltages of the sub-pixels of the same color not performed with detection is obtained by calculating an average of the threshold voltages of the sub-pixels of the same color at upper and lower adjacent positions that have been performed with detection, with the following equations:

$$R''=(R_U+R_L)/2;$$

$$G''=(G_U+G_L)/2;$$

$$B''=(B_U+B_L)/2;$$

Wherein R" is the threshold voltage of a red sub-pixel not performed with detection, $R_U$ and $R_L$ are threshold voltages of the adjacent red sub-pixels that have been performed with detection in the upper and lower directions respectively; G" is the threshold voltage of a green sub-pixel not performed with detection, $G_U$ and $G_L$ are threshold voltages of the adjacent green sub-pixels that have been performed with detection in the upper and lower directions respectively; and B" is the threshold voltage of a blue sub-pixel not performed with detection, $B_U$ and $B_L$ are threshold voltages of the adjacent blue sub-pixels that have been performed with detection in the upper and lower directions respectively.

According to a preferred embodiment of the present invention, the first scan signal and the second scan signal of the n-th scan line, the scan signal of the (n+1)-th scan line, and the data signal are provided by an external timing controller.

According to a preferred embodiment of the present invention, each sub-pixel comprises a switch thin film transistor (TFT), a driving TFT, and an organic light-emitting diode (OLED); the switch TFT has a gate electrically connected to the scan line corresponding to the row of the sub-pixel, a drain electrically connected to the data line corresponding to the column of the sub-pixel, and a source electrically connected to a gate of the driving TFT; the driving TFT has a drain connected to receive a power source voltage, a source electrically connected to an anode of the OLED; and the OLED has a cathode grounded; and, the sensing line is electrically connected to the source of the driving TFT of the corresponding sub-pixel.

Yet another embodiment of the present invention provides a driving method for OLED display panel, which comprises the steps of:

Step 1: providing an OLED display panel;

the OLED display panel being disposed with a driving circuit, the driving circuit comprising: a plurality of pixels arranged in an array, m, n and a being positive integers, a plurality of scan lines arranged from top down and horizontally extending, a plurality of data lines arranged from left to right and vertically extending, and a plurality of sensing lines arranged from left to right and vertically extending;

wherein, each pixel comprising: a red sub-pixel, a green sub-pixel, and a blue sub-pixel, arranged from left to right; a scan line being disposed correspondingly and electrically connected to each row of sub-pixels, a data line being disposed correspondingly and electrically connected to each column of sub-pixels, a sensing line being disposed and electrically connected to corresponding two columns of pixels; the a-th sensing line being electrically connected to all the sub-pixels of the odd-numbered rows in the (2a−1)-th column and all the sub-pixels in the even-numbered rows in the 2a-th column; or, the a-th sensing line being electrically connected to all the sub-pixels of the even-numbered rows in the (2a−1)-th column and all the sub-pixels of the odd-numbered rows in the 2a-th column;

Step S2: in a top-down order, each scan line successively transmitting three scan signals; and within the operation period of the first scan signal, the data line electrically connected to the red sub-pixel transmitting a data signal to drive the red sub-pixel to emit light; within the operation period of the second scan signal, the data line electrically connected to the green sub-pixel transmitting a data signal to drive the green sub-pixel to emit light; within the operation period of the third scan signal, the data line electrically connected to the blue sub-pixel transmitting a data signal to drive the blue sub-pixel to emit light;

the a-th sensing line synchronously detecting threshold voltages of the light-emitting sub-pixels of the odd-numbered rows in the (2a−1)-th column and the light-emitting sub-pixels of the even-numbered rows in the 2a-th column; or, the a-th sensing line synchronously detecting threshold voltages of the light-emitting sub-pixels of the even-numbered rows in the (2a−1)-th column and the light-emitting sub-pixels of the odd-numbered rows in the 2a-th column; so as to accomplish performing detection on half of the sub-pixels in the OLED display panel;

Step S3: based on the threshold voltages of the detected sub-pixels, calculating threshold voltages of the sub-pixels of the same color not performed with detection;

wherein, in Step S3, the threshold voltages of the sub-pixels of the same color not performed with detection being obtained by calculating an average of the threshold voltages of the sub-pixels of the same color at four (i.e., upper, lower, left, and right) adjacent positions having been performed with detection, with the following equations:

$$R''=(R_U+R_L+R_{LF}+R_R)/4;$$

$$G''=(G_U+G_L+G_{LF}+G_R)/4;$$

$$B''=(B_U+B_L+B_{LF}+B_R)/4;$$

Wherein R" being the threshold voltage of a red sub-pixel not performed with detection, $R_U$, $R_L$, $R_{LF}$, and $R_R$ being threshold voltages of the adjacent red sub-pixels having been performed with detection in the upper, lower, left and right directions respectively; G" being the threshold voltage of a green sub-pixel not performed with detection, $G_U$, $G_L$, $G_{LF}$, and $G_R$ being threshold voltages of the adjacent green sub-pixels having been performed with detection in the upper, lower, left and right directions respectively; and B" being the threshold voltage of a blue sub-pixel not performed with detection, $B_U$, $B_L$, $B_{LF}$, and $B_R$ being threshold voltages of the adjacent blue sub-pixels having been performed with detection in the upper, lower, left and right directions respectively;

wherein the first scan signal, the second scan signal, the third scan signal of each scan line, and the data signal being provided by an external timing controller;

wherein each sub-pixel comprising a switch thin film transistor (TFT), a driving TFT, and an organic light-emitting diode (OLED); the switch TFT having a gate electrically connected to the scan line corresponding to the row of the sub-pixel, a drain electrically connected to the data line corresponding to the column of the sub-pixel, and a source electrically connected to a gate of the driving TFT; the driving TFT having a drain connected to receive a power source voltage, a source electrically connected to an anode of the OLED; and the OLED having a cathode grounded;

the sensing line being electrically connected to the source of the driving TFT of the corresponding sub-pixel.

Compared to the known techniques, the present invention provides the following advantages. The present invention provides a driving method for OLED display panel, by using an improved driving circuit: disposing a sensing line corresponding to two columns of pixels, by collaborating with driving circuit timing sequence, the a-th sensing line synchronously detecting threshold voltages of the light-emitting sub-pixels of the odd-numbered rows in the (2a−1)-th column and the light-emitting sub-pixels of the even-numbered rows in the 2a-th column; or, the a-th sensing line synchronously detecting threshold voltages of the light-emitting sub-pixels of the even-numbered rows in the (2a−1)-th column and the light-emitting sub-pixels of the odd-numbered rows in the 2a-th column; so as to accomplish performing detection on half of the sub-pixels in the OLED display panel; based on the threshold voltages of the detected sub-pixels, calculating threshold voltages of the sub-pixels of the same color not performed with detection. As such, the present invention can reduce the number of sensing lines by half to save cost on the condition to obtain the threshold voltages of all the sub-pixels of the OLED display panel. The present invention provides another driving method for OLED display panel, by improving the driving signal timing sequence: in a top-down order, the n-th scan line successively transmitting two scan signals; and within the operation period of the first scan signal, the data line electrically connected to the red sub-pixel transmitting a data signal to drive the red sub-pixel to emit light; within the operation period of the second scan signal, the data line electrically connected to the blue sub-pixel transmitting a data signal to drive the blue sub-pixel to emit light; and then, the (n+1)-th sensing line transmitting a scan signal, and within the operation period of the scan signal, the data line electrically connected to the green sub-pixel transmitting a data signal to drive the green sub-pixel to emit light; the a-th sensing line synchronously detecting threshold voltages of the light-emitting sub-pixels of the a-th column so as to accomplish performing detection on half of the sub-pixels in the OLED display panel; based on the threshold voltages of the detected sub-pixels, calculating threshold of the sub-pixels of the same color not performed with detection. As such, the present invention can reduce the number of detection times of the sensing lines by half to shorten the detection time and improve efficiency on the condition to obtain the threshold voltages of all the sub-pixels of the OLED display panel.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

The present invention provides a driving method for OLED display panel based on the property that the threshold voltages of adjacent sub-pixels are similar in the OLED display panel; that is, the property that a threshold voltage of a sub-pixel is similar to the surrounding sub-pixels of the same color as the sub-pixel.

Figure 1:
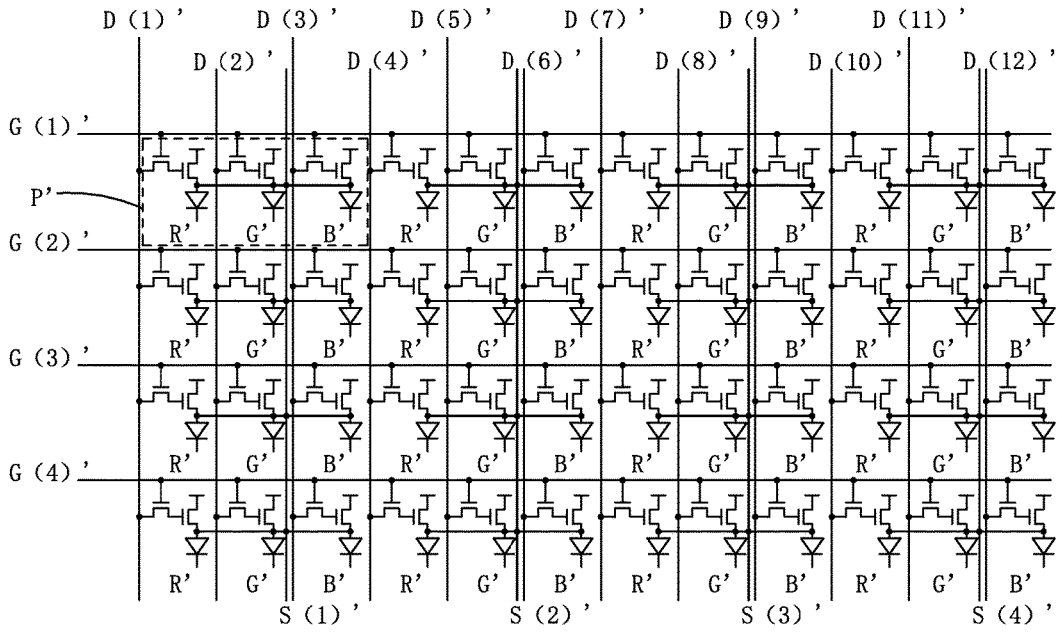
FIG. 1 is a schematic view showing a known driving circuit for OLED display panel.
Figure 2:
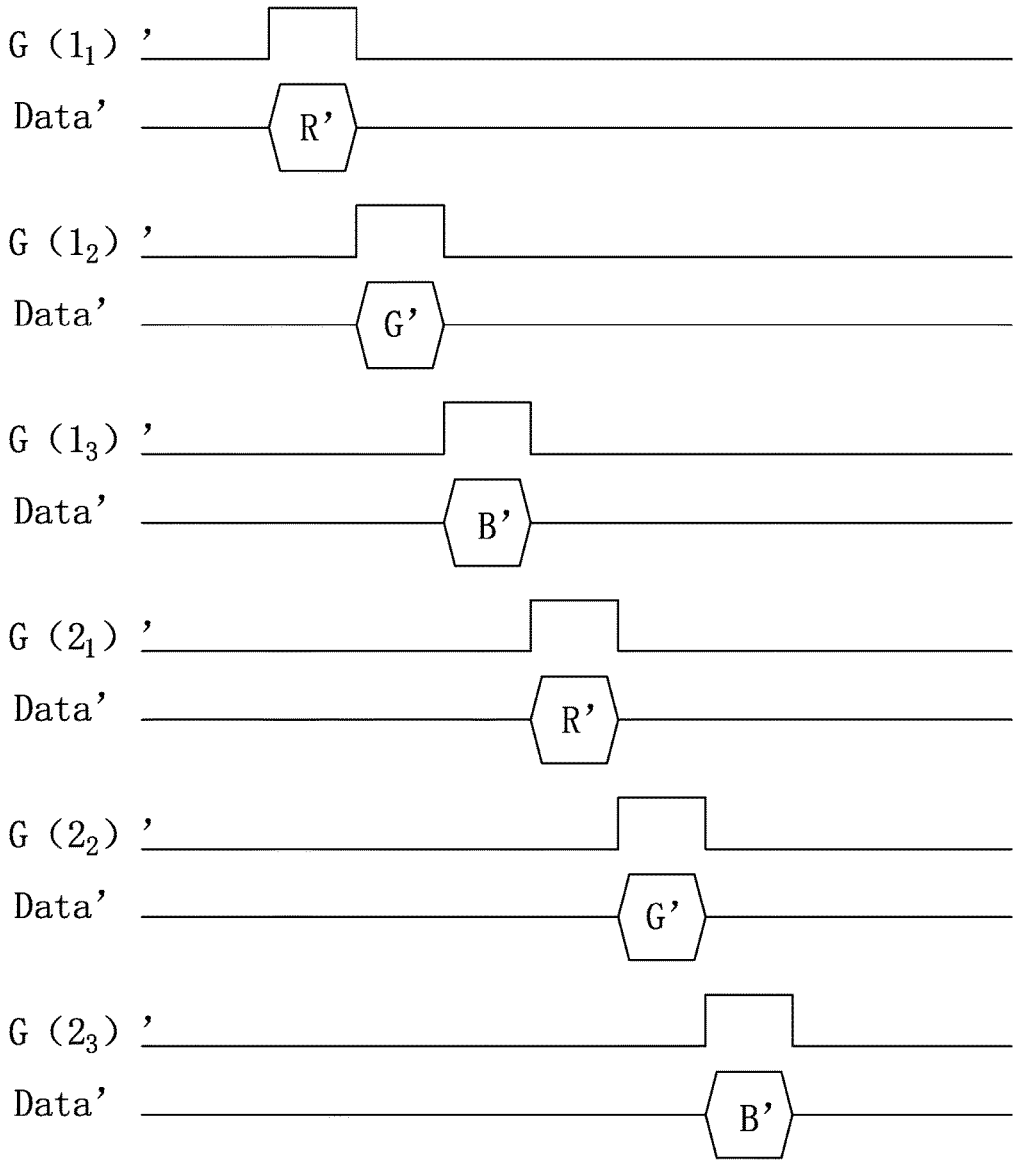
FIG. 2 is a schematic view showing timing sequence corresponding to FIG. 1.
Figure 3:
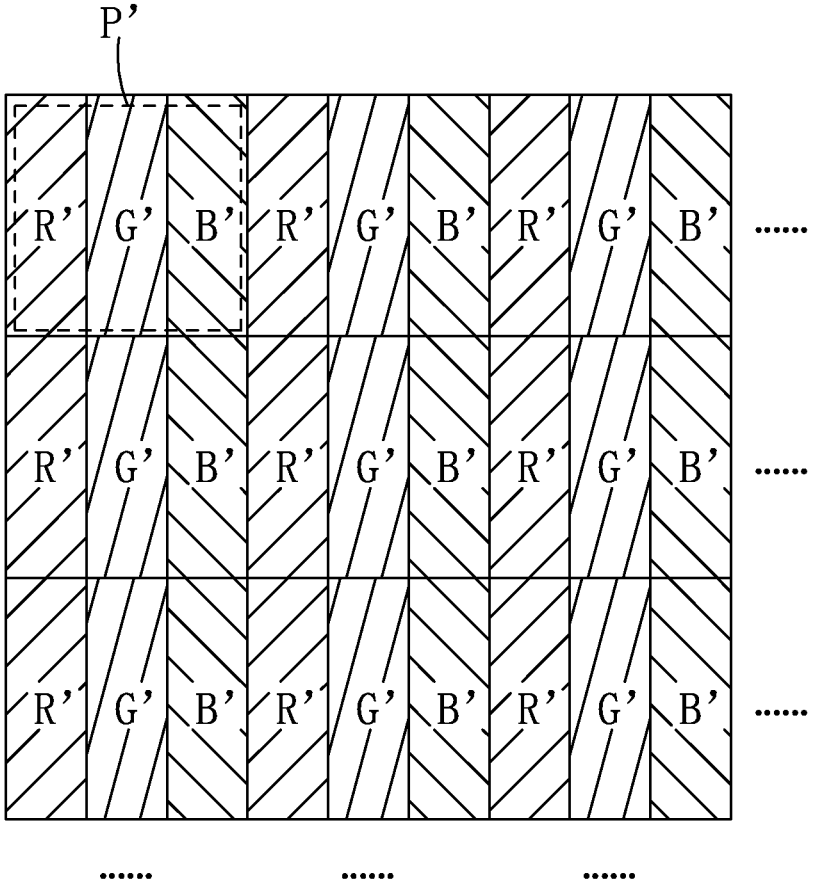
FIG. 3 is a schematic view showing performing detection on all the sub-pixels of a known OLED display panel in FIG. 1.
Figure 4:
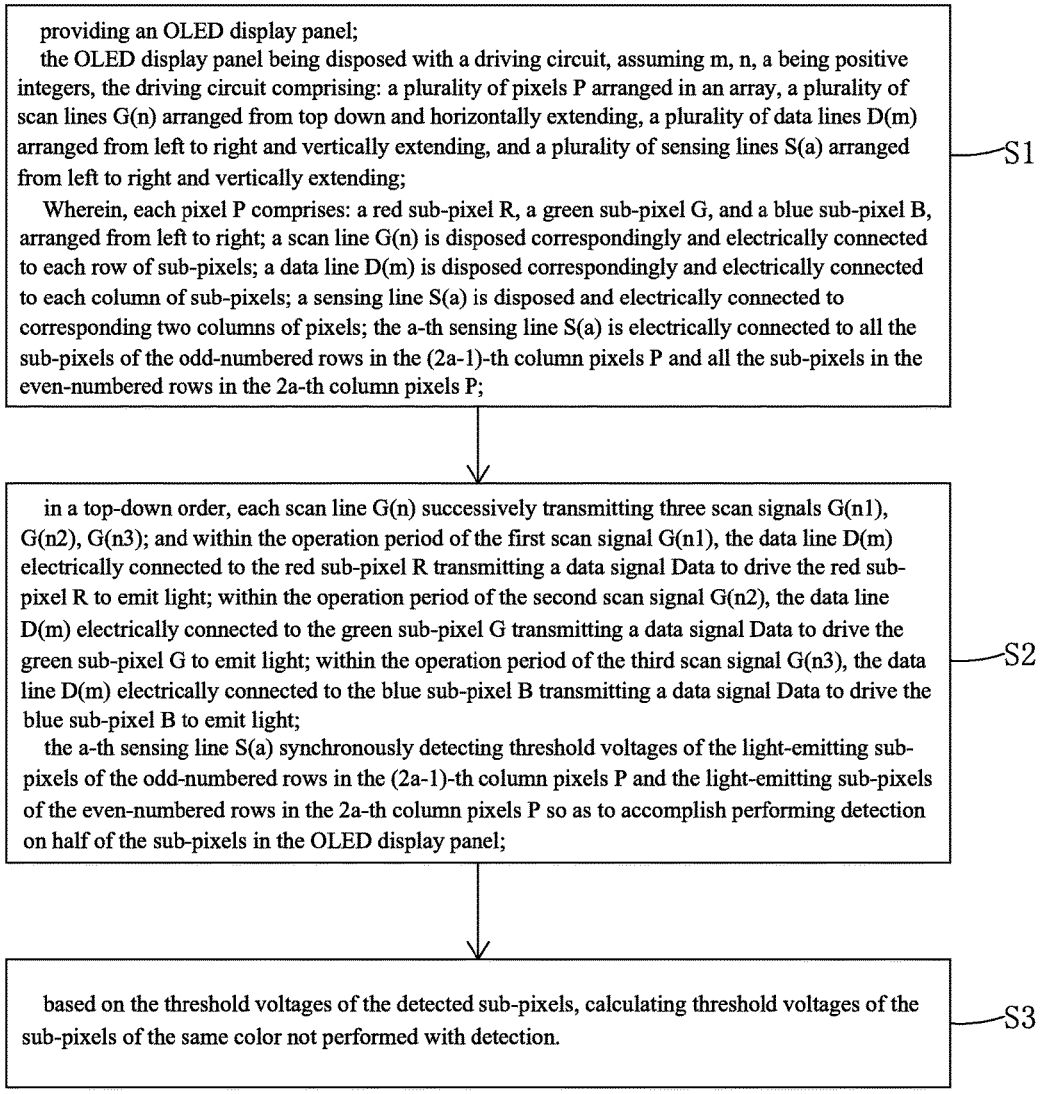
FIG. 4 is a schematic view showing a flowchart of a driving method for OLED display panel provided by an embodiment of the present invention.
Figure 5:
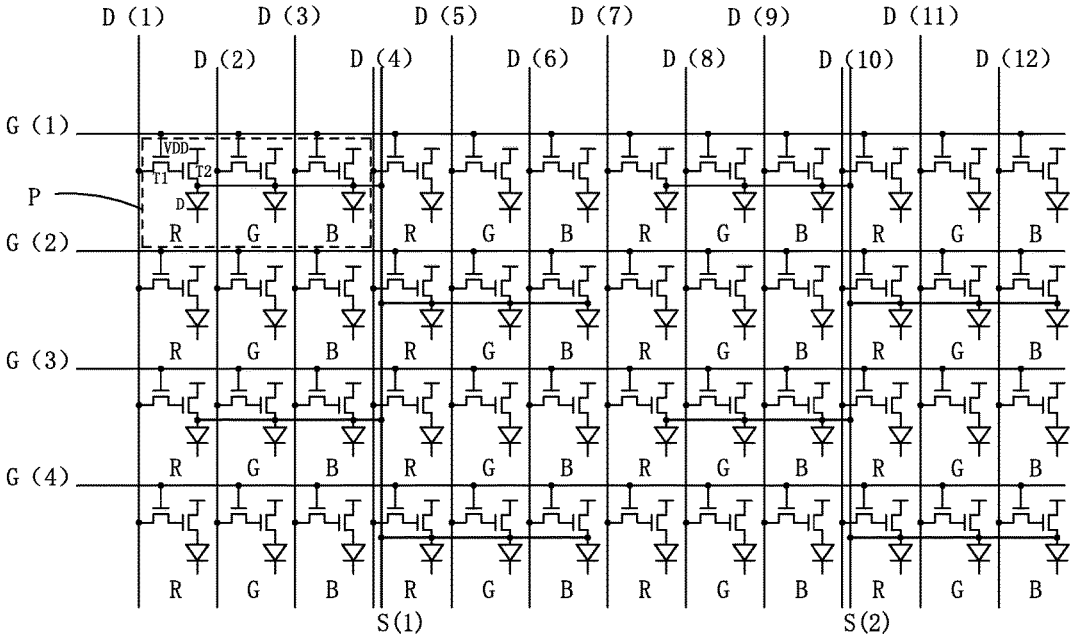
FIG. 5 is a schematic view showing the driving circuit used by the driving method for OLED display panel provided by an embodiment of the present invention.

Referring to FIG. 4, the present invention provides a driving method for OLED display panel, which comprises the steps of:

Step 1: providing an OLED display panel;

the OLED display panel being disposed with a driving circuit, as shown in FIG. 5, assuming m, n, a being positive integers, the driving circuit comprising: a plurality of pixels P arranged in an array, a plurality of scan lines G(n) arranged from top down and horizontally extending (such as, G(1), G(2), G(3), G(4), and so on), a plurality of data lines D(m) arranged from left to right and vertically extending (such as, D(1), D(2), D(3), D(4), D(5), D(6), D(7), D(8), D(9), D(10), D(11), D(12), and so on), and a plurality of sensing lines S(a) arranged from left to right and vertically extending (such as, S(1), S(2), and so on).

Wherein, each pixel P comprises: a red sub-pixel R, a green sub-pixel G, and a blue sub-pixel B, arranged from left to right.

A scan line G(n) is disposed correspondingly and electrically connected to each row of sub-pixels for example, the first scan line G(1) is disposed correspondingly and electrically connected to the first row of sub-pixels; the second scan line G(2) is disposed correspondingly and electrically connected to the second row of sub-pixels; the third scan line G(3) is disposed correspondingly and electrically connected to the third row of sub-pixels; and so on.

A data line D(m) is disposed correspondingly and electrically connected to each column of sub-pixels; for example, the first data line D(1) is disposed correspondingly and electrically connected to the first column of sub-pixels; the second data line D(2) is disposed correspondingly and electrically connected to the second column of sub-pixels; the third data line D(3) is disposed correspondingly and electrically connected to the third column of sub-pixels; and so on.

A sensing line S(a) is disposed and electrically connected to corresponding two columns of pixels; the a-th sensing line S(a) is electrically connected to all the sub-pixels of the odd-numbered rows in the (2a−1)-th column pixels P and all the sub-pixels in the even-numbered rows in the 2a-th column pixels P, as shown in FIG. 5. The first sensing line S(1) is disposed corresponding to the first column pixels P (i.e., the sub-pixels of the first to the third columns) and the second column pixels P (i.e., the sub-pixels of the fourth to the sixth columns), and the first sensing line S(1) is electrically connected to the sub-pixels of the first, third and all the other odd-numbered rows of the first column pixels P and the sub-pixels of the second, fourth and all the other even-numbered rows of the second column pixels; the second sensing line S(2) is disposed corresponding to the third column pixels P (i.e., the sub-pixels of the sixth to the ninth columns) and the fourth column pixels P (i.e., the sub-pixels of the tenth to the twelfth columns), and the second sensing line S(2) is electrically connected to the sub-pixels of the first, third and all the other odd-numbered rows of the first column pixels P and the sub-pixels of the second, fourth and all the other even-numbered rows of the second column pixels; and so on.

Specifically, each sub-pixel comprises a switch thin film transistor (TFT) T1, a driving TFT T2, and an organic light-emitting diode (OLED) D; the switch FT T1 has a gate electrically connected to the scan line G(n) corresponding to the row of the sub-pixel, a drain electrically connected to the data line D(m) corresponding to the column of the sub-pixel, and a source electrically connected to a gate of the driving TFT T2; the driving TFT T2 has a drain connected to receive a power source voltage VDD, a source electrically connected to an anode of the OLED D; and the OLED D has a cathode grounded.

The sensing line S(a) is electrically connected to the source of the driving TFT T2 of the corresponding sub-pixel.

Figure 6:
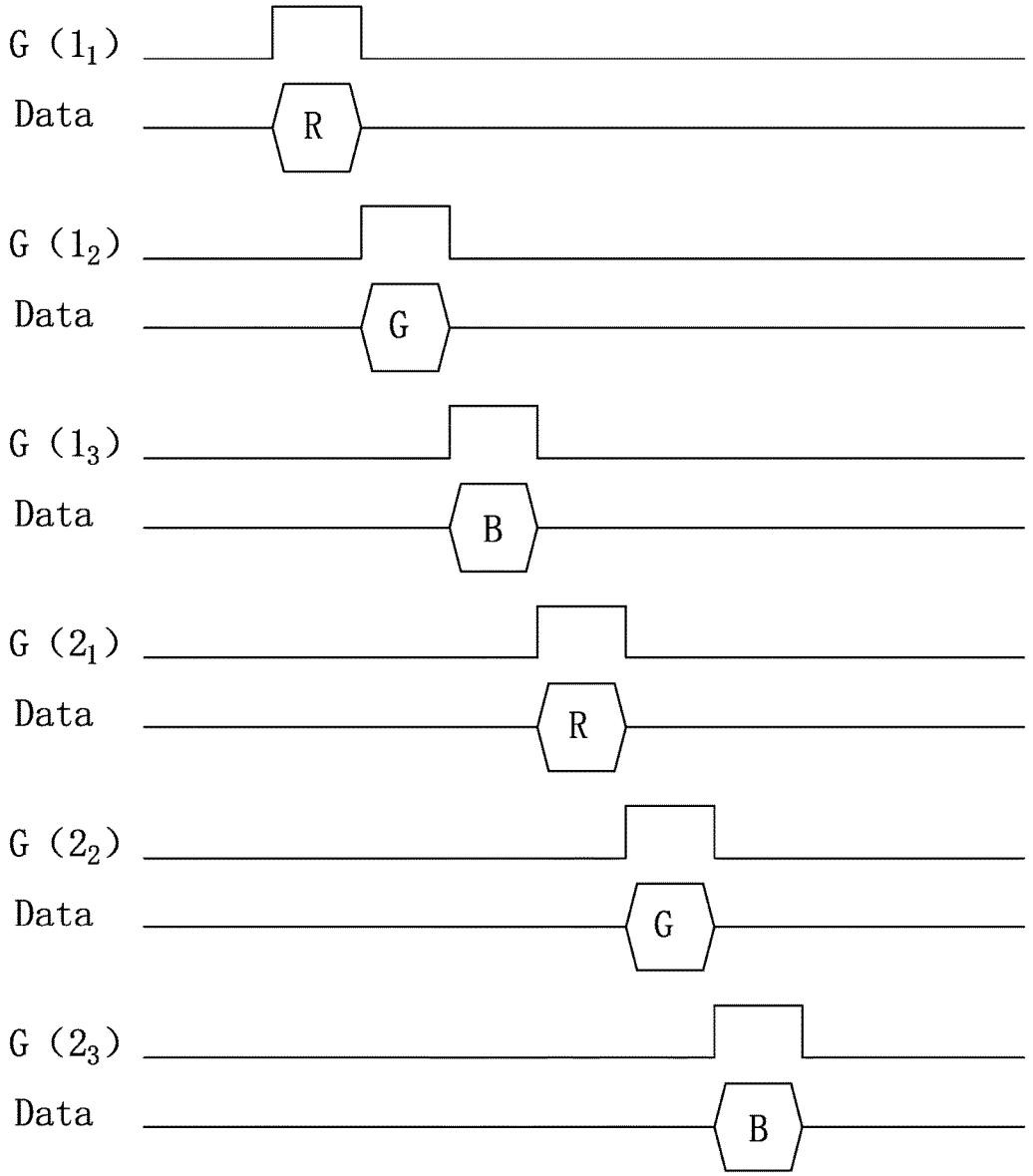
FIG. 6 is a schematic view showing the driving timing sequence of the driving method for OLED display panel provided by an embodiment of the present invention.

Step S2: referring to FIG. 5 and FIG. 6, in a top-down order, each scan line G(n) successively transmitting three scan signals $G(n_1)$, $G(n_2)$, $G(n_3)$; and within the operation period of the first scan signal $G(n_1)$, the data line D(m) electrically connected to the red sub-pixel R transmitting a data signal Data to drive the red sub-pixel R to emit light; within the operation period of the second scan signal $G(n_2)$, the data line D(m) electrically connected to the green sub-pixel G transmitting a data signal Data to drive the green sub-pixel G to emit light; within the operation period of the third scan signal $G(n_3)$, the data line D(m) electrically connected to the blue sub-pixel B transmitting a data signal Data to drive the blue sub-pixel B to emit light;

the a-th sensing line S(a) synchronously detecting threshold voltages of the light-emitting sub-pixels of the odd-numbered rows in the (2a−1)-th column pixels P and the light-emitting sub-pixels of the even-numbered rows in the 2a-th column pixels P so as to accomplish performing detection on half of the sub-pixels in the OLED display panel.

Figure 7:
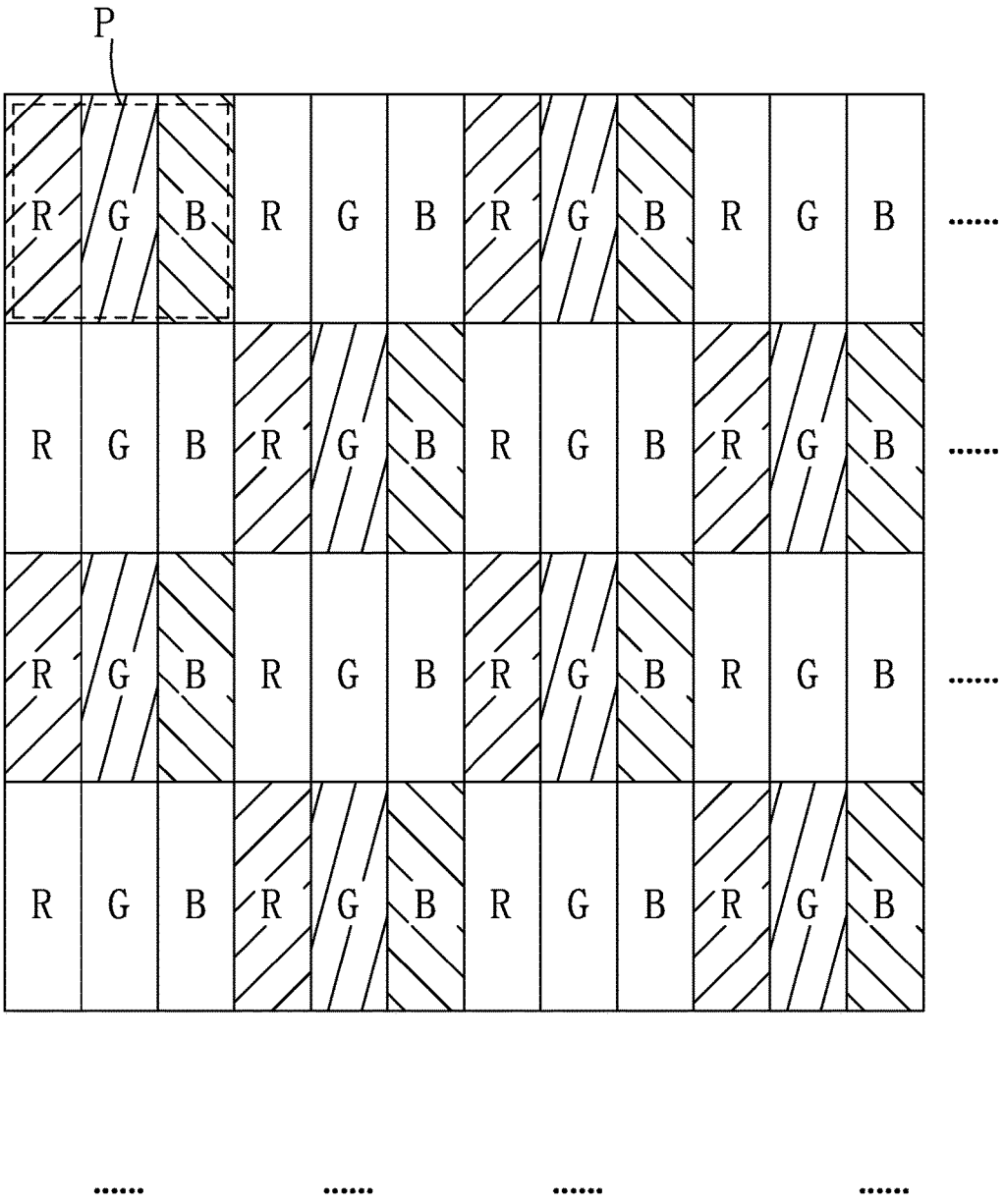
FIG. 7 is a schematic view showing performing detection on half of the sub-pixel of the OLED display panel in the driving method for OLED display panel provided by an embodiment of the present invention.

For example, the first scan line G(1) first transmits successively the first, second and third scan signals $G(\mathbf{1}_1)$, $G(\mathbf{1}_2)$, $G(\mathbf{1}_3)$; and within the operation period of the first scan signal $G(\mathbf{1}_1)$, the data lines D(1), D(4), D(7), and so on, electrically connected to the red sub-pixel R transmit a data signal Data to drive the red sub-pixel R of the first row to emit light; within the operation period of the second scan signal $G(\mathbf{1}_2)$, the data lines D(2), D(5), D(8), and so on, electrically connected to the green sub-pixel G transmit a data signal Data to drive the green sub-pixel G of the first row to emit light; within the operation period of the third scan signal $G(\mathbf{1}_3)$, the data lines D(3), D(6), D(9), and so on, electrically connected to the blue sub-pixel B transmit a data signal Data to drive the blue sub-pixel B of the first row to emit light; the first sensing line S(1) synchronously detecting threshold voltages of the light-emitting sub-pixels of the first row in the first column pixels P and the number of detection times is three; the second sensing line S(2) synchronously detecting threshold voltages of the light-emitting sub-pixels f the first row in the third column pixels P and the number of detection times is three;

Then, the second scan line G(2) transmits successively the first, second and third scan signals $G(\mathbf{2}_1)$, $G(\mathbf{2}_2)$, $G(\mathbf{2}_3)$; and within the operation period of the first scan signal $G(\mathbf{2}_1)$, the data lines D(1), D(4), D(7), and so on, electrically connected to the red sub-pixel R transmit a data signal Data to drive the red sub-pixel R of the second row to emit light; within the operation period of the second scan signal $G(\mathbf{2}_2)$, the data lines D(2), D(5), D(8), and so on, electrically connected to the green sub-pixel G transmit a data signal Data to drive the green sub-pixel G of the second row to emit light; within the operation period of the third scan signal $G(\mathbf{2}_3)$, the data lines D(3), D(6), D(9), and so on, electrically connected to the blue sub-pixel B transmit a data signal Data to drive the blue sub-pixel B of the second row to emit light; the first sensing line S(1) synchronously detecting threshold voltages of the light-emitting sub-pixels of the second row in the second column pixels P and the number of detection times is three; the second sensing line S(2) synchronously detecting threshold voltages of the light-emitting sub-pixels f the second row in the fourth column pixels P and the number of detection times is three; and so on, as shown in FIG. 7, until accomplishing performing detection on half of the sub-pixels in the OLED display panel, i.e., accomplishing detection on half of the sub-pixels in the OLED display panel (the sub-pixel under detection is shaded in the figure).

Apparently, in the above step S1, the a-th sensing line S(a) is electrically connected to all the sub-pixels of the even-numbered rows in the (2a−1)-th column and all the sub-pixels of the odd-numbered rows in the 2a-th column. As such, Step S2 will accomplish detections on the sub-pixels of even-numbered rows in the (2a−1)-th column pixels P and all the sub-pixels of the odd-numbered rows in the 2a-th column pixels P, i.e., accomplishing detection on half of the sub-pixels in the OLED display panel.

Specifically, the first scan signal $G(n_1)$, the second scan signal $G(n_2)$, the third scan signal $G(n_3)$ of each scan line G(n), and the data signal Data are provided by an external timing controller.

Step S3: based on the threshold voltages of the detected sub-pixels, calculating threshold voltages of the sub-pixels of the same color not performed with detection.

Specifically, Step S3 utilizes the property that the threshold voltage of a sub-pixel is similar to the threshold voltages of adjacent sub-pixels of the same color. Therefore, the threshold voltages of the sub-pixels not performed with detection is obtained by calculating an average of the threshold voltages of the sub-pixels of the same color at four (i.e., upper, lower, left, and right) adjacent positions that have been performed with detection, with the following equations:

$$R''=(R_U+R_L+R_{LF}+R_R)/4;$$

$$G''=(G_U+G_L+G_{LF}+G_R)/4;$$

$$B''=(B_U+B_L+B_{LF}+B_R)/4;$$

Wherein R" is the threshold voltage of a red sub-pixel not performed with detection, $R_U$, $R_L$, $R_{LF}$, and $R_R$ are threshold voltages of the adjacent red sub-pixels that have been performed with detection in the upper, lower, left and right directions respectively; G" is the threshold voltage of a green sub-pixel not performed with detection, $G_U$, $G_L$, $G_{LF}$, and $G_R$ are threshold voltages of the adjacent green sub-pixels that have been performed with detection in the upper, lower, left and right directions respectively; and B" is the threshold voltage of a blue sub-pixel not performed with detection, $B_U$, $B_L$, $B_{LF}$, and $B_R$ are threshold voltages of the adjacent blue sub-pixels that have been performed with detection in the upper, lower, left and right directions respectively.

Assume that the number of pixels P in the OLED display panel is 1920×1080, by using the aforementioned driving method for OLED display panel, the number of sensing lines S(a) is 1920/2=960, and the number of detection times for each sensing line S(a) is still 1080×3=3240. Compared to the known technique, the number of sensing lines is reduced by half to achieve saving cost.

Figure 8:
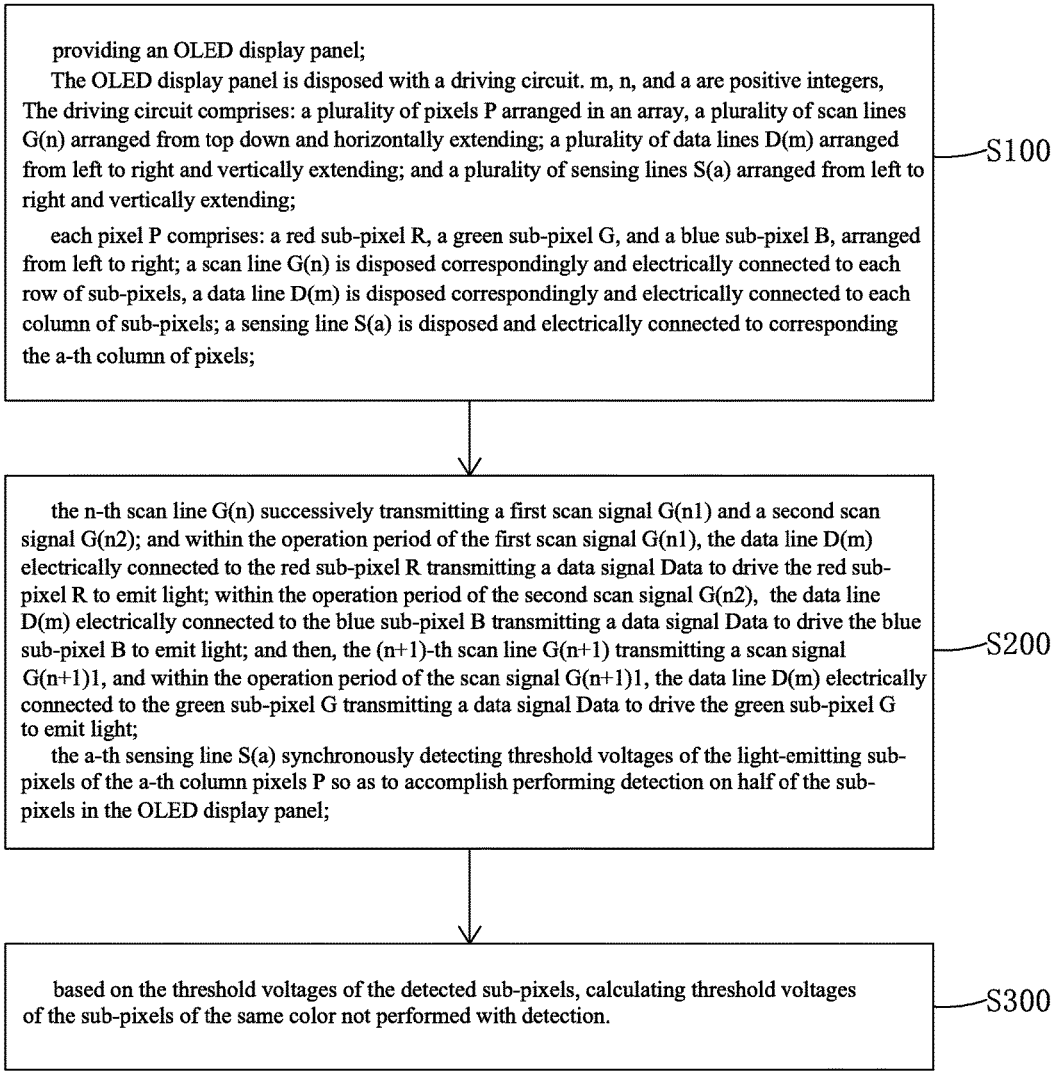
FIG. 8 is a schematic view showing a flowchart of a driving method for OLED display panel provided by another embodiment of the present invention.

Refer to FIG. 8. The present invention provides another driving method for OLED display panel, comprising the steps of:

Step 100: providing an OLED display panel.

Figure 9:
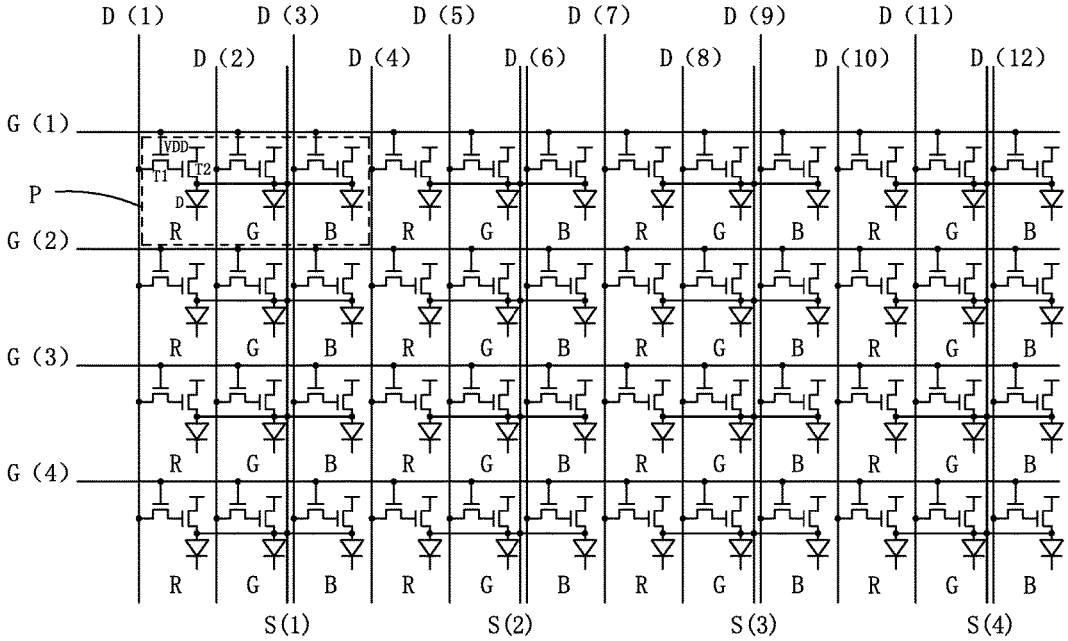
FIG. 9 is a schematic view showing the driving circuit used by the driving method for OLED display panel provided by another embodiment of the present invention.

The OLED display panel is disposed with a driving circuit. As shown in FIG. 9, m, n, and a are positive integers. The driving circuit comprises: a plurality of pixels P arranged in an array, a plurality of scan lines G(n) arranged from top down and horizontally extending (such as, G(1), G(2), G(3), G(4), and so on), a plurality of data lines D(m) arranged from left to right and vertically extending (such as, D(1), D(2), D(3), D(4), D(5), D(6), D(7), D(8), D(9), D(10), D(11), D(12), and so on), and a plurality of sensing lines S(a) arranged from left to right and vertically extending (such as, S(1), S(2), and so on).

Wherein, each pixel P comprises: a red sub-pixel R, a green sub-pixel G, and a blue sub-pixel B, arranged from left to right.

A scan line G(n) is disposed correspondingly and electrically connected to each row of sub-pixels for example, the first scan line G(1) is disposed correspondingly and electrically connected to the first row of sub-pixels; the second scan line G(2) is disposed correspondingly and electrically connected to the second row of sub-pixels; the third scan line G(3) is disposed correspondingly and electrically connected to the third row of sub-pixels; and so on.

A data line D(m) is disposed correspondingly and electrically connected to each column of sub-pixels; for example, the first data line D(1) is disposed correspondingly and electrically connected to the first column of sub-pixels; the second data line D(2) is disposed correspondingly and electrically connected to the second column of sub-pixels; the third data line D(3) is disposed correspondingly and electrically connected to the third column of sub-pixels; and so on.

A sensing line S(a) is disposed and electrically connected to corresponding the a-th column of pixels; as shown in FIG. 9, the first sensing line S(1) is disposed correspondingly to the first column pixels P (i.e., the sub-pixels of the first to the third columns) and electrically connected to the sub-pixels P of the first column; the second sensing line S(2) is disposed corresponding to the second column pixels P (i.e., the sub-pixels of the fourth to the sixth columns) and electrically connected to the sub-pixels P of the second column; the third sensing line S(3) is disposed corresponding to the third column pixels P (i.e., the sub-pixels of the sixth to the ninth columns) and electrically connected to the sub-pixels P of the third column; and so on.

Specifically, each sub-pixel comprises a switch thin film transistor (TFT) T1, a driving TFT T2, and an organic light-emitting diode (OLED) D; the switch FT T1 has a gate electrically connected to the scan line G(n) corresponding to the row of the sub-pixel, a drain electrically connected to the data line D(m) corresponding to the column of the sub-pixel, and a source electrically connected to a gate of the driving TFT T2; the driving TFT T2 has a drain connected to receive a power source voltage VDD, a source electrically connected to an anode of the OLED D; and the OLED D has a cathode grounded.

The sensing line S(a) is electrically connected to the source of the driving TFT T2 of the corresponding sub-pixel.

Figure 10:
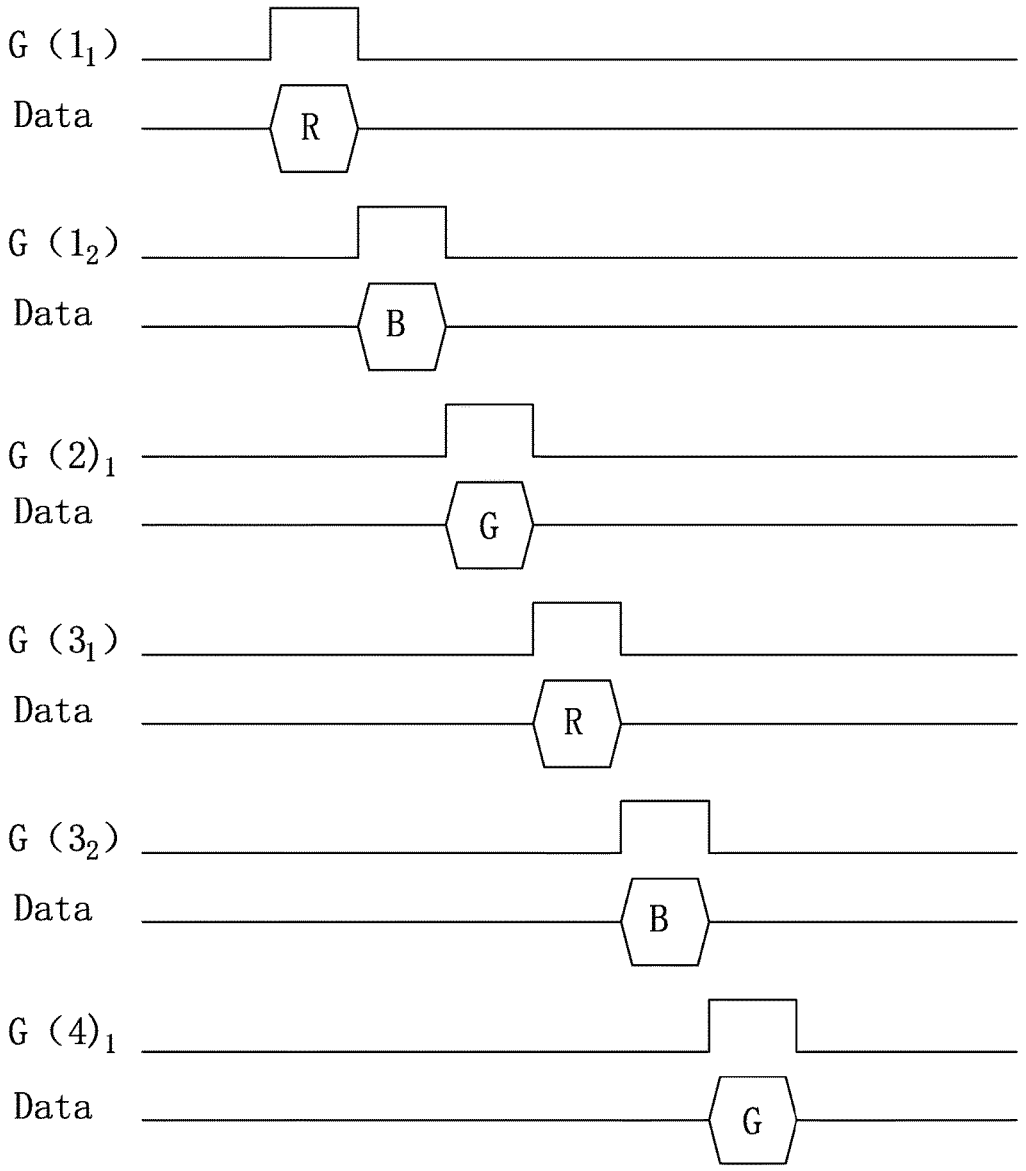
FIG. 10 is a schematic view showing the driving timing sequence of the driving method for OLED display panel provided by another embodiment of the present invention.

Step S200: referring to FIG. 9 and FIG. 10, the n-th scan line G(n) successively transmitting a first scan signal $G(n_1)$ and a second scan signal $G(n_2)$; and within the operation period of the first scan signal $G(n_1)$, the data line D(m) electrically connected to the red sub-pixel R transmitting a data signal Data to drive the red sub-pixel R to emit light; within the operation period of the second scan signal $G(n_2)$, the data line D(m) electrically connected to the blue sub-pixel B transmitting a data signal Data to drive the blue sub-pixel B to emit light; and then, the (n+1)-th scan line G(n+1) transmitting a scan signal $G(n+1)_1$, and within the operation period of the scan signal $G(n+1)_1$, the data line D(m) electrically connected to the green sub-pixel G transmitting a data signal Data to drive the green sub-pixel G to emit light;

the a-th sensing line S(a) synchronously detecting threshold voltages of the light-emitting sub-pixels of the a-th column pixels P so as to accomplish performing detection on half of the sub-pixels in the OLED display panel.

For example, the first scan line G(1) first successively transmits a first scan signal $G(1_1)$ and a second scan signal $G(1_2)$; and within the operation period of the first scan signal $G(1_1)$, the data lines D(1), D(4), D(7), and so on, electrically connected to the red sub-pixel R transmit a data signal Data to drive the red sub-pixel R of the first row to emit light; within the operation period of the second scan signal $G(1_2)$, the data lines D(3), D(6), D(9), and so on, electrically connected to the blue sub-pixel B transmit a data signal Data to drive the blue sub-pixel B of the first row to emit light; the first sensing line S(1) synchronously detects threshold voltages of the red and blue sub-pixels R, B of the first row of the first column pixel P, and the number of detection times is two; the second sensing line S(2) synchronously detects threshold voltages of the red and blue sub-pixels R, B of the first row of the second column pixel P, and the number of detection times is two; and so on.

Then, the second scan line G(2) transmitting a scan signal $G(2)_1$, and within the operation period of the scan signal $G(2)_1$, the data lines D(2), D(5), D(8), and so on, electrically connected to the green sub-pixel G transmit a data signal Data to drive the green sub-pixel G to emit light; the first sensing line S(1) synchronously detects threshold voltage of the green sub-pixel G of the second row of the first column pixel P, and the number of detection times is one; the second sensing line S(2) synchronously detects threshold voltages of the green sub-pixel G of the second row of the second column pixel P, and the number of detection times is one; and so on.

Then, the third scan line G(3) successively transmits a first scan signal $G(3_1)$ and a second scan signal $G(3_2)$; and within the operation period of the first scan signal $G(3_1)$, the data lines D(1), D(4), D(7), and so on, electrically connected to the red sub-pixel R transmit a data signal Data to drive the red sub-pixel R of the third row to emit light; within the operation period of the second scan signal $G(3_2)$, the data lines D(3), D(6), D(9), and so on, electrically connected to the blue sub-pixel B transmit a data signal Data to drive the blue sub-pixel B of the third row to emit light; the first sensing line S(1) synchronously detects threshold voltages of the red and blue sub-pixels R, B of the third row of the first column pixel P, and the number of detection times is two; the second sensing line S(2) synchronously detects threshold voltages of the red and blue sub-pixels R, B of the third row of the second column pixel P, and the number of detection times is two; and so on.

Figure 11:
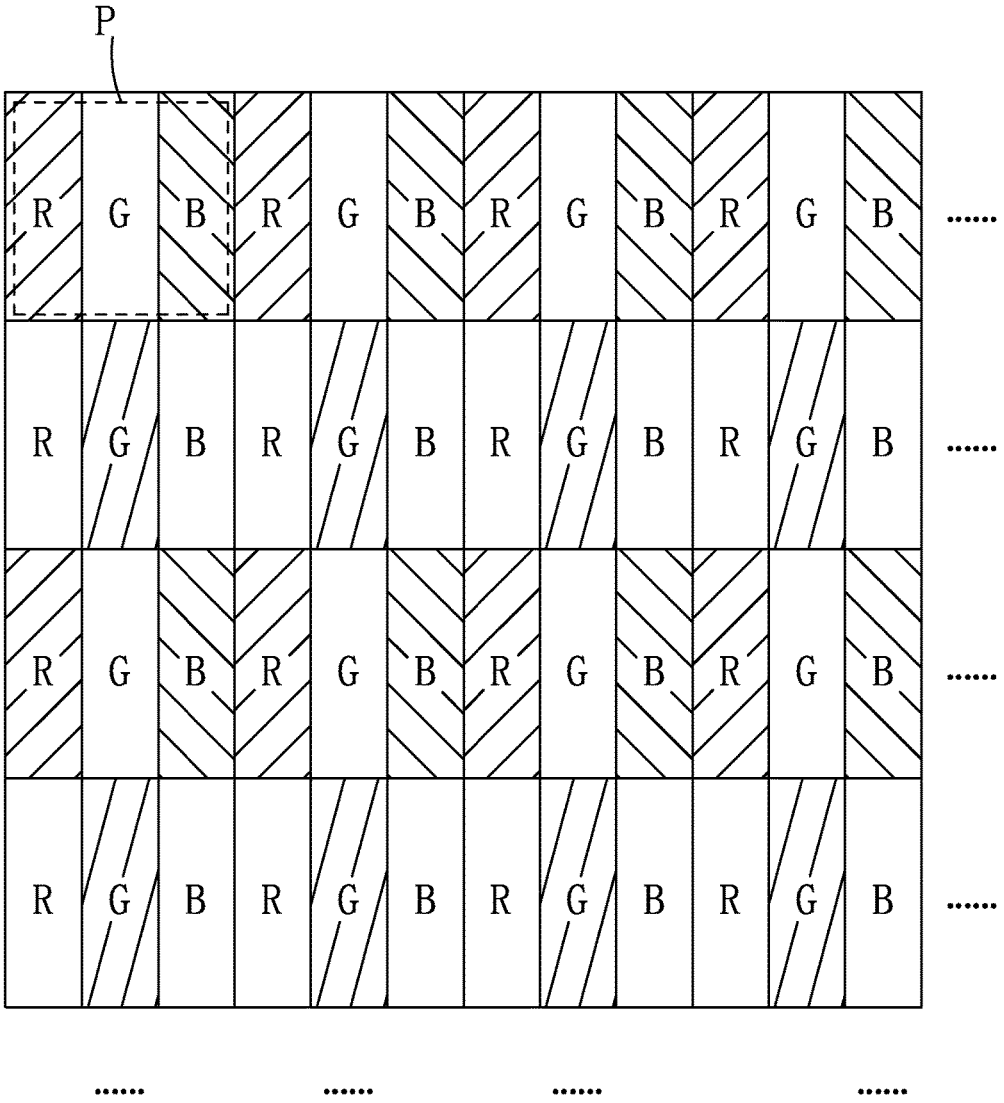
FIG. 11 is a schematic view showing performing detection on half of the sub-pixel of the OLED display panel in the driving method for OLED display panel provided by another embodiment of the present invention.

Then, the fourth scan line G(4) transmitting a scan signal $G(4)_1$, and within the operation period of the scan signal $G(4)_1$, the data lines D(2), D(5), D(8), and so on, electrically connected to the green sub-pixel G transmit a data signal Data to drive the green sub-pixel G to emit light; the first sensing line S(1) synchronously detects threshold voltage of the green sub-pixel G of the fourth row of the first column pixel P, and the number of detection times is one; the second sensing line S(2) synchronously detects threshold voltages of the green sub-pixel G of the fourth row of the second column pixel P, and the number of detection times is one; and so on; as shown in FIG. 11, until accomplishing performing detection on the red and blue sub-pixels R, B of the odd-numbered rows and the green sub-pixels G of the even-numbered rows in the OLED display panel, i.e., accomplishing detection on half of the sub-pixels in the OLED display panel (the sub-pixel under detection is shaded in the figure).

Apparently, Step S200 can also adjust the driving signals. For example, the first scan line G(1) first transmits a scan signal, the second scan line G(2) successively transmits a first and a second scan signals, the third scan line G(3) transmits a scan signal, and the fourth scan line G(4) successively transmits a first and a second scan signals, and so on, so as to accomplish performing detection on the green sub-pixels G of the odd-numbered rows and the red and blue sub-pixels R, B of the even-numbered rows in the OLED display panel, i.e., accomplishing detection on half of the sub-pixels in the OLED display panel.

Specifically, the first scan signal $G(n_1)$ and the second scan signal $G(n_2)$ of the n-th scan line G(n), the scan signal $G(n+1)_1$ of the (n+1)-th scan line G(n+1), and the data signal Data are provided by an external timing controller.

Step S300: based on the threshold voltages of the detected sub-pixels, calculating threshold of the sub-pixels of the same color not performed with detection.

Specifically, Step S300 utilizes the property that the threshold voltage of a sub-pixel is similar to the threshold voltages of adjacent sub-pixels of the same color. Therefore, the threshold voltages of the sub-pixels of the same color not performed with detection is obtained by calculating an average of the threshold voltages of the sub-pixels of the same color at upper and lower adjacent positions that have been performed with detection, with the following equations:

$$R''=(R_U+R_L)/2;$$

$$G''=(G_U+G_L)/2;$$

$$B''=(B_U+B_L)/2;$$

Wherein R" is the threshold voltage of a red sub-pixel not performed with detection, $R_U$ and $R_L$ are threshold voltages of the adjacent red sub-pixels that have been performed with detection in the upper and lower directions respectively; G" is the threshold voltage of a green sub-pixel not performed with detection, $G_U$ and $G_L$ are threshold voltages of the adjacent green sub-pixels that have been performed with detection in the upper and lower directions respectively; and B" is the threshold voltage of a blue sub-pixel not performed with detection, $B_U$ and $B_L$ are threshold voltages of the adjacent blue sub-pixels that have been performed with detection in the upper and lower directions respectively.

Assume that the number of pixels P in the OLED display panel is 1920×1080, by using the aforementioned driving method for OLED display panel, the number of sensing lines S(a) is still 1920, and the number of detection times for each sensing line S(a) is 2×540+540=1620. Compared to the known technique, the number of detection times is reduced by half to shorten detection time and improve efficiency.

In summary, the present invention provides a driving method for OLED display panel, by using an improved driving circuit: disposing a sensing line corresponding to two columns of pixels, by collaborating with driving circuit timing sequence, the a-th sensing line synchronously detecting threshold voltages of the light-emitting sub-pixels of the odd-numbered rows in the (2a−1)-th column and the light-emitting sub-pixels of the even-numbered rows in the 2a-th column; or, the a-th sensing line synchronously detecting threshold voltages of the light-emitting sub-pixels of the even-numbered rows in the (2a−1)-th column and the light-emitting sub-pixels of the odd-numbered rows in the 2a-th column; so as to accomplish performing detection on half of the sub-pixels in the OLED display panel; based on the threshold voltages of the detected sub-pixels, calculating threshold voltages of the sub-pixels of the same color not performed with detection. As such, the present invention can reduce the number of sensing lines by half to save cost on the condition to obtain the threshold voltages of all the sub-pixels of the OLED display panel. The present invention provides another driving method for OLED display panel, by improving the driving signal timing sequence: in a top-down order, the n-th scan line successively transmitting two scan signals; and within the operation period of the first scan signal, the data line electrically connected to the red sub-pixel transmitting a data signal to drive the red sub-pixel to emit light; within the operation period of the second scan signal, the data line electrically connected to the blue sub-pixel transmitting a data signal to drive the blue sub-pixel to emit light; and then, the (n+1)-th sensing line transmitting a scan signal, and within the operation period of the scan signal, the data line electrically connected to the green sub-pixel transmitting a data signal to drive the green sub-pixel to emit light; the a-th sensing line synchronously detecting threshold voltages of the light-emitting sub-pixels of the a-th column so as to accomplish performing detection on half of the sub-pixels in the OLED display panel; based on the threshold voltages of the detected sub-pixels, calculating threshold of the sub-pixels of the same color not performed with detection. As such, the present invention can reduce the number of detection times of the sensing lines by half to shorten the detection time and improve efficiency on the condition to obtain the threshold voltages of all the sub-pixels of the OLED display panel.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A driving method for organic light-emitting diode (OLED) display panel, comprising the steps of:

Step 1: providing an OLED display panel;

the OLED display panel being disposed with a driving circuit, m, n, a being positive integers, the driving circuit comprising: a plurality of pixels arranged in an array, a plurality of scan lines arranged from top down and horizontally extending, a plurality of data lines arranged from left to right and vertically extending, and a plurality of sensing lines arranged from left to right and vertically extending;

wherein, each pixel comprising: a red sub-pixel, a green sub-pixel, and a blue sub-pixel, arranged from left to right; a scan line being disposed correspondingly and electrically connected to each row of sub-pixels, a data line being disposed correspondingly and electrically connected to each column of sub-pixels, a sensing line being disposed and electrically connected to corresponding two columns of pixels; the a-th sensing line being electrically connected to all the sub-pixels of the odd-numbered rows in the (2a−1)-th column and all the sub-pixels in the even-numbered rows in the 2a-th column; or, the a-th sensing line being electrically connected to all the sub-pixels of the even-numbered rows in the (2a−1)-th column and all the sub-pixels of the odd-numbered rows in the 2a-th column;

Step S2: in a top-down order, each scan line successively transmitting three scan signals; and within the operation period of the first scan signal, the data line electrically connected to the red sub-pixel transmitting a data signal to drive the red sub-pixel to emit light; within the operation period of the second scan signal, the data line electrically connected to the green sub-pixel transmitting a data signal to drive the green sub-pixel to emit light; within the operation period of the third scan signal, the data line electrically connected to the blue sub-pixel transmitting a data signal to drive the blue sub-pixel to emit light;

the a-th sensing line synchronously detecting threshold voltages of the light-emitting sub-pixels of the odd-numbered rows in the (2a−1)-th column and the light-emitting sub-pixels of the even-numbered rows in the 2a-th column; or, the a-th sensing line synchronously detecting threshold voltages of the light-emitting sub-pixels of the even-numbered rows in the (2a−1)-th column and the light-emitting sub-pixels of the odd-numbered rows in the 2a-th column; so as to accomplish performing detection on half of the sub-pixels in the OLED display panel;

Step S3: based on the threshold voltages of the detected sub-pixels, calculating threshold voltages of the sub-pixels of the same color not performed with detection.

2. The driving method for OLED display panel as claimed in claim 1, wherein in Step S3, the threshold voltages of the sub-pixels of the same color not performed with detection is obtained by calculating an average of the threshold voltages of the sub-pixels of the same color at four (i.e., upper, lower, left, and right) adjacent positions that have been performed with detection, with the following equations:

$$R''=(R_U+R_L+R_{LF}+R_R)/4;$$

$$G''=(G_U+G_L+G_{LF}+G_R)/4;$$

$$B''=(B_U+B_L+B_{LF}+B_R)/4;$$

wherein R" is the threshold voltage of a red sub-pixel not performed with detection, $R_U$, $R_L$, $R_{LF}$, and $R_R$ are threshold voltages of the adjacent red sub-pixels that have been performed with detection in the upper, lower, left and right directions respectively; G" is the threshold voltage of a green sub-pixel not performed with detection, $G_U$, $G_L$, $G_{LF}$, and $G_R$ are threshold voltages of the adjacent green sub-pixels that have been performed with detection in the upper, lower, left and right directions respectively; and B" is the threshold voltage of a blue sub-pixel not performed with detection, $B_U$, $B_L$, $B_{LF}$, and $B_R$ are threshold voltages of the adjacent blue sub-pixels that have been performed with detection in the upper, lower, left and right directions respectively.

3. The driving method for OLED display panel as claimed in claim 1, wherein the first scan signal, the second scan signal, the third scan signal of each scan line, and the data signal are provided by an external timing controller.

4. The driving method for OLED display panel as claimed in claim 1, wherein each sub-pixel comprises a switch thin film transistor (TFT), a driving TFT, and an organic light-emitting diode (OLED); the switch TFT has a gate electrically connected to the scan line corresponding to the row of the sub-pixel, a drain electrically connected to the data line corresponding to the column of the sub-pixel, and a source electrically connected to a gate of the driving TFT; the driving TFT has a drain connected to receive a power source voltage, a source electrically connected to an anode of the OLED; and the OLED has a cathode grounded; and, the sensing line is electrically connected to the source of the driving TFT of the corresponding sub-pixel.

5. A driving method for OLED display panel, comprising the steps of:

Step 100: providing an OLED display panel;

the OLED display panel being disposed with a driving circuit, m, n, a being positive integers, the driving circuit comprising: a plurality of pixels arranged in an array, a plurality of scan lines arranged from top down and horizontally extending, a plurality of data lines arranged from left to right and vertically extending, and a plurality of sensing lines arranged from left to right and vertically extending;

wherein, each pixel comprising: a red sub-pixel, a green sub-pixel, and a blue sub-pixel, arranged from left to right; a scan line being disposed correspondingly and electrically connected to each row of sub-pixels, a data line being disposed correspondingly and electrically connected to each column of sub-pixels, a sensing line being disposed and electrically connected to corresponding two columns of pixels; the a-th sensing line being electrically connected to all the sub-pixels in the a-th column;

Step S200: in a top-down order, the n-th scan line successively transmitting two scan signals; and within the operation period of the first scan signal, the data line electrically connected to the red sub-pixel transmitting a data signal to drive the red sub-pixel to emit light; within the operation period of the second scan signal, the data line electrically connected to the blue sub-pixel transmitting a data signal to drive the blue sub-pixel to emit light; and then, the (n+1)-th scan line transmitting a scan signal, and within the operation period of the scan signal, the data line electrically connected to the green sub-pixel transmitting a data signal to drive the green sub-pixel to emit light;

the a-th sensing line synchronously detecting threshold voltages of the light-emitting sub-pixels of the a-th column so as to accomplish performing detection on half of the sub-pixels in the OLED display panel;

Step S300: based on the threshold voltages of the detected sub-pixels, calculating threshold of the sub-pixels of the same color not performed with detection.

6. The driving method for OLED display panel as claimed in claim 5, wherein in Step S300, the threshold voltages of the sub-pixels of the same color not performed with detection is obtained by calculating an average of the threshold voltages of the sub-pixels of the same color at upper and lower adjacent positions that have been performed with detection, with the following equations:

$$R''=(R_U+R_L)/2;$$

$$G''=(G_U+G_L)/2;$$

$$B''=(B_U+B_L)/2;$$

wherein R" is the threshold voltage of a red sub-pixel not performed with detection, $R_U$ and $R_L$ are threshold voltages of the adjacent red sub-pixels that have been performed with detection in the upper and lower directions respectively; G" is the threshold voltage of a green sub-pixel not performed with detection, $G_U$ and $G_L$ are threshold voltages of the adjacent green sub-pixels that have been performed with detection in the upper and lower directions respectively; and B" is the threshold voltage of a blue sub-pixel not performed with detection, $B_U$ and $B_L$ are threshold voltages of the adjacent blue sub-pixels that have been performed with detection in the upper and lower directions respectively.

7. The driving method for OLED display panel as claimed in claim 5, wherein the first scan signal and the second scan signal of the n-th scan line, the scan signal of the (n+1)-th scan line, and the data signal are provided by an external timing controller.

8. The driving method for OLED display panel as claimed in claim 5, wherein each sub-pixel comprises a switch thin film transistor (TFT), a driving TFT, and an organic light-emitting diode (OLED); the switch TFT has a gate electrically connected to the scan line corresponding to the row of the sub-pixel, a drain electrically connected to the data line corresponding to the column of the sub-pixel, and a source electrically connected to a gate of the driving TFT; the driving TFT has a drain connected to receive a power source voltage, a source electrically connected to an anode of the OLED; and the OLED has a cathode grounded; and, the sensing line is electrically connected to the source of the driving TFT of the corresponding sub-pixel.

9. A driving method for organic light-emitting diode (OLED) display panel, comprising the steps of:

Step 1: providing an OLED display panel;

the OLED display panel being disposed with a driving circuit, m, n, a being positive integers, the driving circuit comprising: a plurality of pixels arranged in an array, a plurality of scan lines arranged from top down and horizontally extending, a plurality of data lines arranged from left to right and vertically extending, and a plurality of sensing lines arranged from left to right and vertically extending;

wherein, each pixel comprising: a red sub-pixel, a green sub-pixel, and a blue sub-pixel, arranged from left to right; a scan line being disposed correspondingly and electrically connected to each row of sub-pixels, a data line being disposed correspondingly and electrically connected to each column of sub-pixels, a sensing line being disposed and electrically connected to corresponding two columns of pixels; the a-th sensing line being electrically connected to all the sub-pixels of the odd-numbered rows in the (2a−1)-th column and all the sub-pixels in the even-numbered rows in the 2a-th column; or, the a-th sensing line being electrically connected to all the sub-pixels of the even-numbered rows in the (2a−1)-th column and all the sub-pixels of the odd-numbered rows in the 2a-th column;

Step S2: in a top-down order, each scan line successively transmitting three scan signals; and within the operation period of the first scan signal, the data line electrically connected to the red sub-pixel transmitting a data signal to drive the red sub-pixel to emit light; within the operation period of the second scan signal, the data line electrically connected to the green sub-pixel transmitting a data signal to drive the green sub-pixel to emit light; within the operation period of the third scan signal, the data line electrically connected to the blue sub-pixel transmitting a data signal to drive the blue sub-pixel to emit light;

the a-th sensing line synchronously detecting threshold voltages of the light-emitting sub-pixels of the odd-numbered rows in the (2a−1)-th column and the light-emitting sub-pixels of the even-numbered rows in the 2a-th column; or, the a-th sensing line synchronously detecting threshold voltages of the light-emitting sub-pixels of the even-numbered rows in the (2a−1)-th column and the light-emitting sub-pixels of the odd-numbered rows in the 2a-th column; so as to accomplish performing detection on half of the sub-pixels in the OLED display panel;

Step S3: based on the threshold voltages of the detected sub-pixels, calculating threshold voltages of the sub-pixels of the same color not performed with detection;

wherein in Step S3, the threshold voltages of the sub-pixels of the same color not performed with detection is obtained by calculating an average of the threshold voltages of the sub-pixels of the same color at four (i.e., upper, lower, left, and right) adjacent positions that have been performed with detection, with the following equations:

$$R''=(R_U+R_L+R_{LF}+R_R)/4;$$

$$G''=(G_U+G_L+G_{LF}+G_R)/4;$$

$$B''=(B_U+B_L+B_{LF}+B_R)/4;$$

wherein R" is the threshold voltage of a red sub-pixel not performed with detection, $R_U$, $R_L$, $R_{LF}$, and $R_R$ are threshold voltages of the adjacent red sub-pixels that have been performed with detection in the upper, lower, left and right directions respectively; G" is the threshold voltage of a green sub-pixel not performed with detection, $G_U$, $G_L$, $G_{LF}$, and $G_R$ are threshold voltages of the adjacent green sub-pixels that have been performed with detection in the upper, lower, left and right directions respectively; and B" is the threshold voltage of a blue sub-pixel not performed with detection, $B_U$, $B_L$, $B_{LF}$, and $B_R$ are threshold voltages of the adjacent blue sub-pixels that have been performed with detection in the upper, lower, left and right directions respectively;

wherein the first scan signal, the second scan signal, the third scan signal of each scan line, and the data signal are provided by an external timing controller;

wherein each sub-pixel comprises a switch thin film transistor (TFT), a driving TFT, and an organic light-emitting diode (OLED); the switch FT has a gate electrically connected to the scan line corresponding to the row of the sub-pixel, a drain electrically connected to the data line corresponding to the column of the sub-pixel, and a source electrically connected to a gate of the driving TFT; the driving TFT has a drain connected to receive a power source voltage, a source electrically connected to an anode of the OLED; and the OLED has a cathode grounded; and, the sensing line is electrically connected to the source of the driving TFT of the corresponding sub-pixel.

* * * * *